US009550231B2

(12) United States Patent
Barge et al.

(10) Patent No.: US 9,550,231 B2
(45) Date of Patent: Jan. 24, 2017

(54) MOULD

(71) Applicant: TBS ENGINEERING LIMITED, Cheltenham (GB)

(72) Inventors: Christopher S. Barge, Bristol (GB); Mark Ormerod, Cheltenham (GB)

(73) Assignee: TBS ENGINEERING LIMITED, Cheltenham (GB)

( * ) Notice: Subject to any disclaimer, the term of this patent is extended or adjusted under 35 U.S.C. 154(b) by 0 days.

(21) Appl. No.: 14/410,222

(22) PCT Filed: Jul. 3, 2013

(86) PCT No.: PCT/GB2013/051759

§ 371 (c)(1),
(2) Date: Dec. 22, 2014

(87) PCT Pub. No.: WO2014/006401

PCT Pub. Date: Jan. 9, 2014

(65) Prior Publication Data

US 2015/0224570 A1 Aug. 13, 2015

(30) Foreign Application Priority Data

Jul. 4, 2012 (GB) ..... 1211813.9

(51) Int. Cl.
*B22C 9/06* (2006.01)
*B22D 19/04* (2006.01)
*B22D 25/04* (2006.01)

(52) U.S. Cl.
CPC ..... *B22C 9/065* (2013.01); *B22D 19/04* (2013.01); *B22D 25/04* (2013.01)

(58) Field of Classification Search
CPC ..... B22C 9/065; B22D 19/04; B22D 25/04
See application file for complete search history.

(56) References Cited

U.S. PATENT DOCUMENTS 4,108,417 A 8/1978 Simonton et al.
4,173,326 A * 11/1979 Oxenreider ..... B22D 25/04 164/DIG. 1
4,729,542 A 3/1988 Bechtold

FOREIGN PATENT DOCUMENTS

GB 1 136 009 A 12/1968
JP 7-245101 9/1995
WO WO-2007/128958 A1 11/2007

OTHER PUBLICATIONS

International Search Report for Application No. PCT/GB2013/051759, dated Feb. 13, 2014.
Search Report for Application No. GB1211813.9, dated Oct. 5, 2012.

* cited by examiner

*Primary Examiner* — Kevin P Kerns
*Assistant Examiner* — Steven Ha
(74) *Attorney, Agent, or Firm* — Marshall, Gerstein & Borun LLP

(57) ABSTRACT

A mold for molding post and strap in a cast on strap machine includes a mold body having an upper surface, a cavity in the upper surface for molding a strap and an opening aligned with the cavity for receiving a water-coolable insert for molding a post. The opening extends through the mold with its mouth in the upper surface to enable the insert to be inserted into the opening through the mouth. The mold body further includes a removable plate for being received in the mouth to retain releasably the insert in the opening and for defining the cavity.

3 Claims, 2 Drawing Sheets

MOULD

This is invention relates to moulds and, in particular, to moulds suitable for use on cast on strap machines.

In the production of many types of battery, groups of battery plates are interconnected together by moulded straps and, typically, at either end there is a strap and post formation moulded to enable external connections to be made with the battery plates. The most usual way of moulding such straps and posts is using a cast-on-strap machine in which assembled batches of plates have their lugs dipped into mould cavities, which form the required straps.

The formation of the post/strap combinations require a significantly greater quantity of lead and therefore can take much longer to cool, potentially extending the operation cycle time. It is therefore desirable to provide extra localised cooling and FIGS. 1 and 2 illustrate the current arrangements. In these Figures, a mould generally indicated at 10 includes a mould body 11 having a mould cavity 12 defined in its upper surface 13 and an aligned opening 14 extending from the base of the mould body 11 up to the cavity 12. The mould further comprises a water-cooled insert 15 that defines an axially extending post mould cavity (not shown). As can be seen in FIG. 2, the insert 15 is inserted from below into the opening 14 so that the cavity 12 is aligned and contiguous with the post cavity (not shown). Flexible hosing provides an inlet and an outlet for water to pass through a jacket (not shown) within the insert 15 that substantially surrounds the post cavity (not shown).

Whilst this known arrangement provides effective cooling for the post, the Applicants have appreciated that it suffers from at least two significant drawbacks. First, it is very awkward to introduce the insert into the mould body 11 from beneath and this becomes a significant issue for those customers who use their cast on strap machines to mould components of a range of different battery sizes and types when the inserts will need to be changed. In many incidences the factory practice is to dismount the whole mould from the machine so that the inserts can be more readily changed and then the mould is replaced. It will be understood that this introduces significant downtime.

The Applicants have also appreciated that during this procedure the hoses frequently become damaged and they are not readily replaced because they tend to have bespoke dimensions.

From one aspect, the invention consists in a mould for moulding post and strap in a cast on strap machine including a mould body having an upper surface, a cavity in the upper surface for moulding a strap and an opening aligned with the cavity for receiving a water-coolable insert for moulding a post characterised in that the opening extends through the mould with its mouth in the upper surface to enable the insert to be inserted into the opening through the mouth and in that the mould body further includes a removable plate for being received in the mouth to retain releasably the insert in the opening and for defining the cavity.

In a preferred embodiment, the mould further includes a manifold at the end of the opening remote from the mouth; the manifold includes plug/socket formations for receiving cooperating formations on the insert to enable connections for a water supply. It is particularly preferred that the manifold is connected to rigid inlet and outlet pipes.

Although the invention has been defined above, it is to be understood that it includes any inventive combination of the features set out above or in the following description.

The invention may be performed in various ways and a specific embodiment will now be described by way of example in connection with the following drawings, in which.

Figure 1:
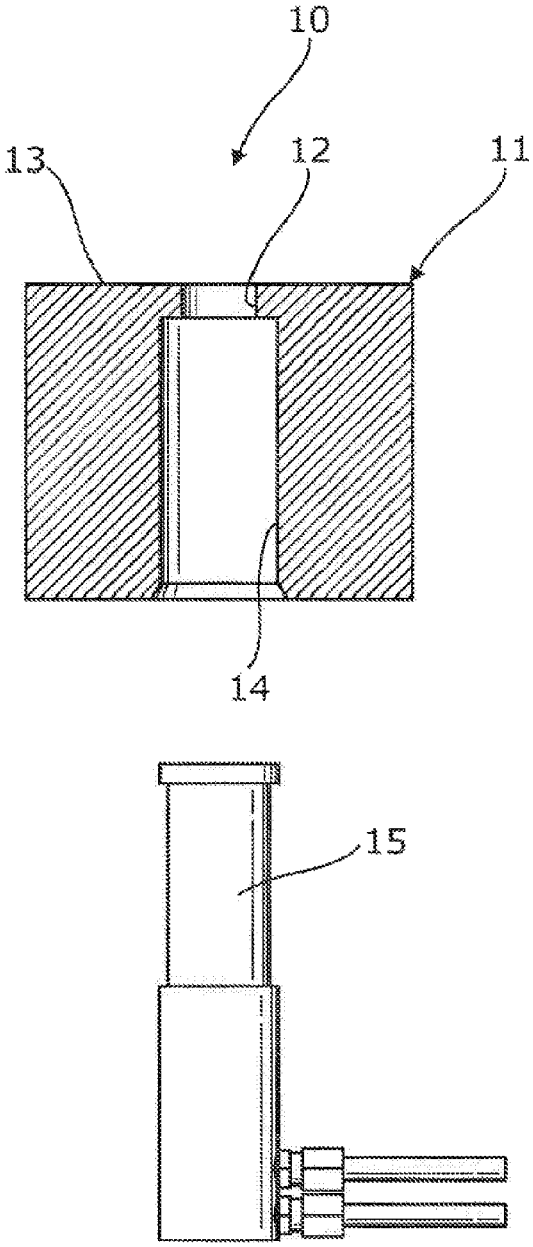
Fig. 1 Prior Art
Figure 2:
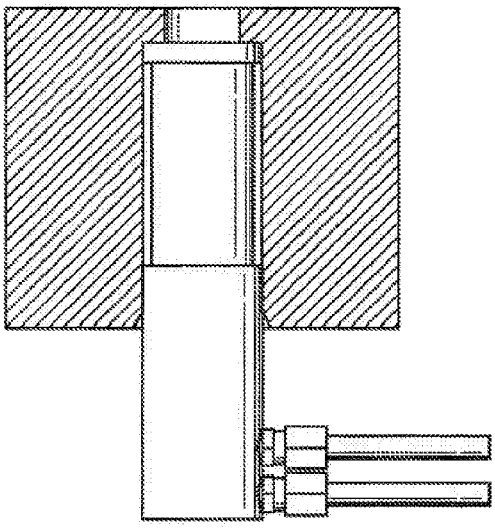
Fig. 2 Prior Art
Figure 3:
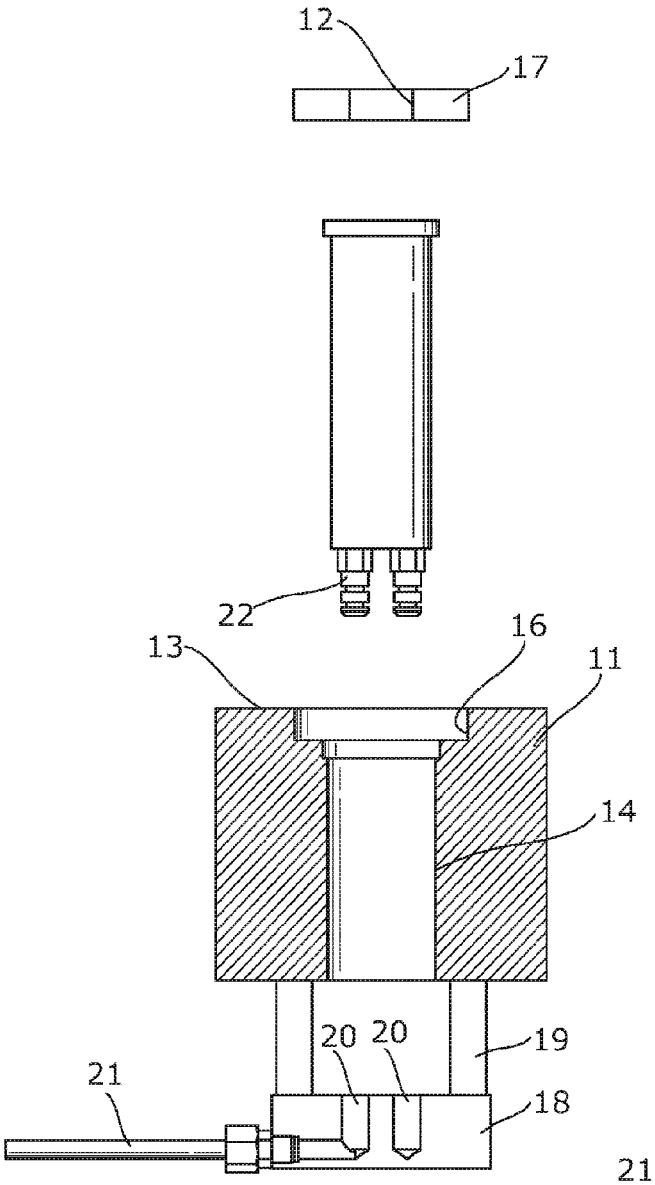
FIG. 3 is an exploded view of a mould assembly.
Figure 4:
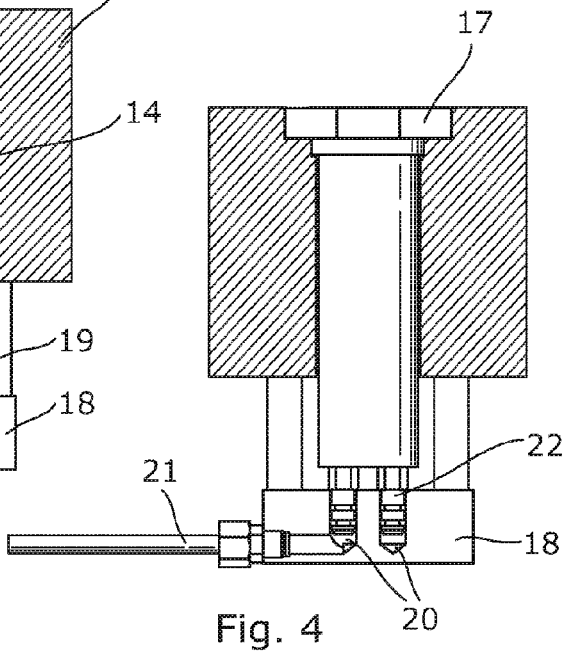
FIG. 4 is an assembled view.

As can be seen in FIG. 3, the opening 14 now has an enlarged mouth 16 opening into the upper surface 13. This enables the selected insert 15 to be top loaded into the opening 14. A retaining plate 17 can then be located into the mouth 16. It will be seen that the plate 17 now defines the cavity 12. The plate 17 can be fixed by any suitable fastening arrangement.

A manifold 18 is suspended from the base of the mould body 11 by a pair of struts 19. The manifold defines a pair of sockets 20, which are connected to respective input and output pipes. The connection for the input pipe 21 only is shown but the other connection corresponds. The insert has cooperating main or plug connections 22 which engage sealingly into the sockets 20 so that water can flow in through the inlet pipe 21 up through the respective socket 20 into the associated plug 21, through the jacket (not shown) and then out through the other plug 21, socket 20 and the outlet pipe (not shown).

It will be understood that this arrangement is a significant advance on the previous design in that it allows the inserts 15 to be inserted through the top of the mould making insert changes considerably easier and faster; it introduces the possibility of having bespoke cavities 12 associated with particular post constructions and it is not necessary to connect and disconnect the inlet and outlet pipes each time the insert is changed. This not only increases the speed of changeover but also reduces the likelihood of damage to the inlet and outlet pipes. Further, because the inlet and outlet pipes do not need to in any way alter position for connection and disconnection, they can be made of rigid material and, therefore, are far more robust.

The spacing of the manifold 18 from the mould body 11 prevents unnecessary heating of the water passing through the manifold and the spaces 19 may conveniently be thermal insulators.

The invention claimed is:

1. A post and strap moulding system for a cast on strap machine, the system comprising:

a post and strap mould including:

a mould body having an upper surface, a cavity in the upper surface for moulding a strap and an opening aligned with the cavity and configured to receive a water-coolable post moulding insert wherein:

the opening extends through the mould and a mouth is provided in the upper surface of the mould to enable the insert to be inserted into the opening through the mouth and wherein:

the mould body further includes a removable plate having a cavity provided therein, the plate being configured to be received in the mouth to releasably retain the insert within the opening and with the cavity of the removable plate being aligned and contiguous with the water-coolable post moulding insert; and the system further comprising a manifold at an end of the opening remote from the mouth, the manifold defining plug/socket formations for receiving cooperating formations of the water-coolable post moulding insert to enable connection for a water supply.

2. A post and strap moulding system as claimed in claim 1 wherein the manifold is connected to inlet and outlet pipes.

3. A post and strap moulding system as claimed in claim 1, wherein thermal insulating spaces are provided between the manifold and the water-coolable post moulding insert.

* * * * *